US006960883B2

(12) United States Patent
Mizoziri et al.

(10) Patent No.: US 6,960,883 B2
(45) Date of Patent: Nov. 1, 2005

(54) FLASH LAMP DEVICE AND FLASH EMITTING DEVICE

(75) Inventors: Takahumi Mizoziri, Hyogo (JP); Kenichiro Matsushita, Hyogo (JP); Kazuyuki Mori, Hyogo (JP)

(73) Assignee: Ushio Denki Kabushiki Kaisya, Tokyo (JP)

( * ) Notice: Subject to any disclaimer, the term of this patent is extended or adjusted under 35 U.S.C. 154(b) by 0 days.

(21) Appl. No.: 10/327,103

(22) Filed: Dec. 24, 2002

(65) Prior Publication Data

US 2003/0122489 A1 Jul. 3, 2003

(30) Foreign Application Priority Data

Dec. 28, 2001 (JP) ..... 2001-400622

(51) Int. Cl.[7] ..... H01J 17/44; H01J 65/00; H01J 11/00

(52) U.S. Cl. ..... 313/594; 313/234; 313/607

(58) Field of Search ..... 313/234, 607, 313/594, 492, 622, 623, 238, 613; 372/69–91

(56) References Cited

U.S. PATENT DOCUMENTS

| | | | | | |
|---|---|---|---|---|---|
| 1,738,991 | A | * | 12/1929 | Fink et al. | 313/564 |
| 3,733,599 | A | | 5/1973 | Fantozzi | 340/343 |
| 4,047,064 | A | * | 9/1977 | Cosco et al. | 313/594 |
| 4,156,890 | A | * | 5/1979 | Hebert et al. | 362/16 |
| 4,207,541 | A | * | 6/1980 | Karger et al. | 372/35 |
| 4,342,940 | A | * | 8/1982 | Mrusko et al. | 313/594 |
| 4,736,136 | A | * | 4/1988 | Persiani et al. | 313/635 |
| 6,008,583 | A | * | 12/1999 | Breuer et al. | 313/594 |
| 6,380,679 | B1 | | 4/2002 | Leers et al. | 313/601 |
| 6,628,079 | B2 | * | 9/2003 | Golkowski et al. | 313/160 |
| 2004/0032218 | A1 | * | 2/2004 | Dunisch | 315/209 CD |

FOREIGN PATENT DOCUMENTS

| | | |
|---|---|---|
| JP | 57-119447 | 7/1982 |
| JP | 57-138768 | 8/1982 |
| JP | 57-157452 | 9/1982 |
| JP | 57-158944 | 9/1982 |
| JP | S57-168464 | 10/1982 |
| JP | 57-205958 | 12/1982 |
| JP | 59-189551 | 10/1984 |
| JP | H05-89846 | 4/1993 |
| JP | 2001-84962 | 3/2001 |
| JP | 2001-527696 | 12/2001 |

* cited by examiner

*Primary Examiner*—Joseph Williams
*Assistant Examiner*—Peter Macchiarolo
(74) *Attorney, Agent, or Firm*—Oblon, Spivak, McClelland, Maier & Neustadt, P.C.

(57) ABSTRACT

A flash lamp device having a flash lamp that includes an arc tube in which a pair of electrodes are disposed in opposition and a high voltage supply proximal conductor which extends parallel to the electrodes, on the exterior of the arc tube of the flash lamp. The high voltage supply proximal conductor is supported in an interior space of a sealed tubular body having a dielectric member with a greater permittivity than that of air.

7 Claims, 14 Drawing Sheets

FLASH LAMP DEVICE AND FLASH EMITTING DEVICE

BACKGROUND OF THE INVENTION

1. Field of the Invention

The present invention relates to a flash lamp device and a flash emitting device which can be used favorably in the heat treatment and so on of semiconductor substrates or liquid crystal substrates, for example.

2. Description of the Related Art

A flash lamp device comprising, for example, a flash lamp with an arc tube in which a pair of electrodes are disposed facing each other and a high voltage supply proximal conductor (to be referred to simply as "proximal conductor" herein below) known as a trigger electrode on the exterior of the arc tube of this flash lamp is widely known in the prior art. Specifically, a device with a constitution in which the proximal conductor is wound around the outer peripheral surface of an arc tube in spiral form so as to contact this surface (see Japanese Patent Application Laid-Open No. S59-189551), a device with a constitution in which a proximal conductor is provided in contact with the outer peripheral surface of an arc tube extending in the tubular axis direction along the outer peripheral surface of the arc tube (see Japanese Patent Application Laid-Open No. 2001-84962), and a device with a constitution in which a reflecting mirror provided in parallel with an arc tube doubles as a proximal conductor (see U.S. Pat. No. 3,733,599) and so on may be cited as examples thereof.

Investigations have been conducted recently into the use of flash lamp devices with such constitutions as heat sources in heat treatment devices for performing rapid heat treatment on semiconductor substrates and liquid crystal substrates, for example, and according to a heat treatment device having as a heat source a flash emitting device comprising such flash lamp devices, the surface layer part of the semiconductor substrate or liquid crystal substrate to be treated can be heated to a predetermined temperature in an extremely short amount of time.

Typically, in order to perform heat treatment on a semiconductor substrate, heating must be performed such that only the surface layer part of the semiconductor substrate rises in temperature to between 1000° C. and 1400° C., and therefore a heat treatment device having as a heat source a flash emitting device comprising flash lamp devices is specifically required to emit a semiconductor substrate to be treated with light of an energy of at least 2 J/cm$^2$ within a short period of time such as 1 msec. In order to achieve this, the peak energy that is introduced into the flash lamp must reach $5\times10^6$ W.

However, since the light emitted from the flash lamp in the flash lamp device is of a high energy, the metallic material which constitutes the proximal conductor (also referred to as "high voltage supply proximal conductor material" herein below) sputters and scatters upon reception of this light with the result that the high voltage supply proximal conductor material becomes attached to the outer peripheral surface of the arc tube and this high voltage supply proximal conductor material is thus caused to rise in temperature. As a result, problems such as cracking of the arc tube occur due to the difference in expansion coefficient with the arc tube material, for example glass.

Further, in a flash lamp device constituted such that the proximal conductor directly contacts the outer peripheral surface of the arc tube, a problem occurs in that the proximal conductor thermally expands upon reception of light emitted from the flash lamp, causing friction between the proximal conductor and the outer peripheral surface of the arc tube such that the arc tube is damaged, and eventually, as the lamp is repeatedly illuminated and extinguished, this frictional damage leads to the breakage of the arc tube.

This problem is particularly notable in devices constituted such that the end portion of the proximal conductor contacts the arc tube.

Another problem is that as the lamp is repeatedly illuminated and extinguished, the proximal conductor is separated from the outer peripheral surface of the arc tube, creating a layer of air between the arc tube and proximal conductor which results in a deterioration of the trigger energy action such that even if the flash lamp itself is in normal working order, erroneous emissions occur and the flash lamp cannot be illuminated.

SUMMARY OF THE INVENTION

The present invention has been designed on the basis of such circumstances, and it is an object thereof to provide a flash lamp device and flash emitting device which produce sufficient trigger energy and no light emission errors, and which also have a long working life.

A flash lamp device of the present invention comprises a flash lamp having an arc tube with a pair of electrodes disposed facing one another, and a high voltage supply proximal conductor which extends between these electrodes on the exterior of the arc tube of this flash lamp, wherein a dielectric member having a larger permittivity than air is installed between the arc tube of the flash lamp and the proximal conductor.

The dielectric member in the flash lamp device of the present invention is preferably constituted by silica glass.

In the flash lamp device of the present invention, the dielectric member is constituted by a sealed tubular body (glass tube) and the high voltage supply proximal conductor is supported in a position in the interior of this sealed tubular body.

In a flash lamp of this kind, it is preferable for at least one end of the proximal conductor to be sealed inside the sealed tubular body and for the interior of this sealed tubular body to be set as a vacuum atmosphere. It is also preferable for at least one end of the high voltage supply proximal conductor to be sealed inside the sealed tubular body and for the interior of this sealed tubular body to be set as an inert gas atmosphere.

It is also preferable for the high voltage supply proximal conductor to be slidably supported by protruding portions formed by inward protrusions of the inner peripheral surface of the sealed tubular body.

It is further preferable for a solid getter to be provided in the interior of the sealed tubular body.

A flash emitting device of the present invention comprises a plurality of the aforementioned flash lamp devices, each of this plurality of flash lamp devices being constituted either such that the arc tube, the high voltage supply proximal conductor, and the dielectric material are supported separately on a common base, or such that the arc tube and a composite body comprising the high voltage supply proximal conductor and dielectric member are supported separately on a common base.

DESCRIPTION OF THE PREFERRED EMBODIMENTS

Embodiments of the present invention will be described below in detail.

(First Embodiment)

Figure 1:
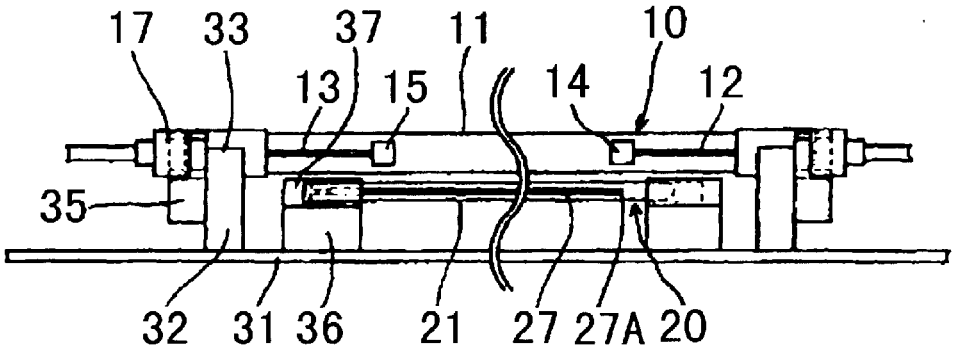
FIG. 1 is an illustrative view showing an example of the constitution of a flash lamp device of the present invention comprised in a flash emitting device.
Figure 2:
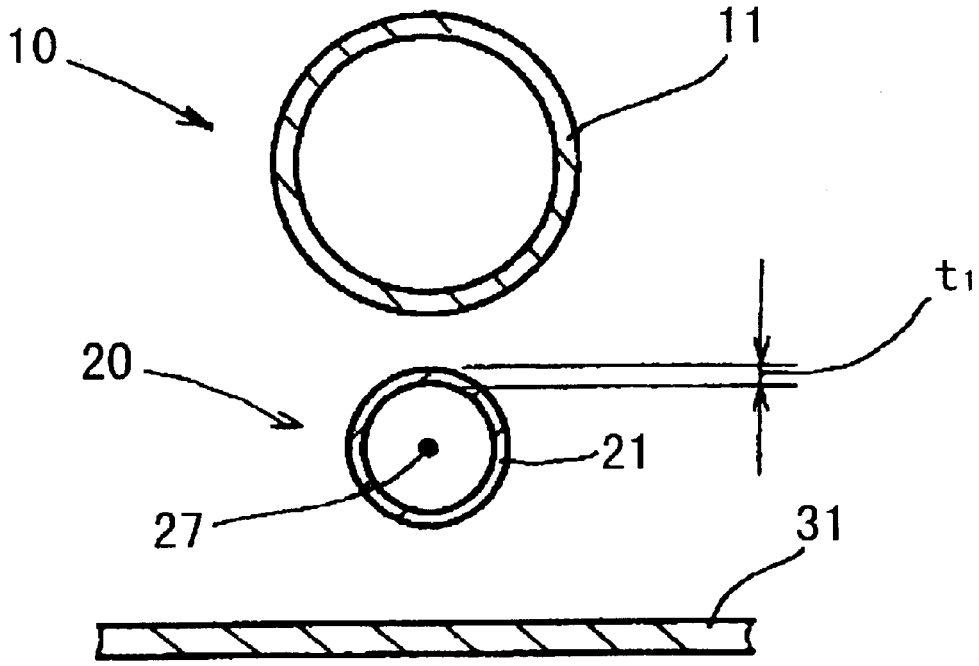
FIG. 2 is an illustrative sectional view showing the positional relationship between a flash lamp and a trigger member in the flash lamp device of FIG. 1.
Figure 3:
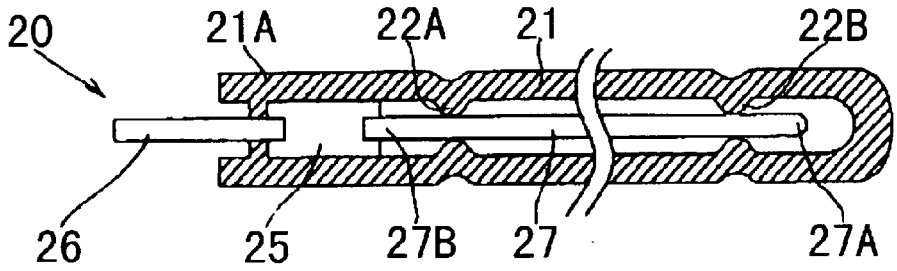
FIG. 3 is an illustrative sectional view showing the constitution of a trigger member in the flash lamp device of FIG. 1.

FIG. 1 is an illustrative view showing an example of the constitution of a flash lamp device of the present invention comprised in a flash emitting device, FIG. 2 is an illustrative sectional view showing the positional relationship between a flash lamp and a trigger member in the flash lamp device of FIG. 1, and FIG. 3 is an illustrative sectional view showing a trigger member in the flash lamp device of FIG. 1.

This flash lamp device has a tubular form with both ends sealed and comprises in its interior a flash lamp 10 constituted by a silica glass arc tube 11 in straight tubular type which defines a light emitting space, and a trigger member (to be referred to as "first trigger member" herein below) 20 installed parallel to the arc tube 11 in the flash lamp 10, constituted by a straight tubular type dielectric member (to be referred to as "dielectric tube" herein below) 21 having a tubular type with both ends sealed, and comprising in the interior space thereof a high voltage supply proximal conductor (to be referred to simply as "proximal conductor" herein below) 27.

Here, "high voltage supply proximal conductor" indicates a component which is not electrically connected to the electrodes (anode and cathode) disposed inside the arc tube which constitutes the flash lamp but is connected to a dielectric breakdown producing high voltage generator.

In this example, the flash lamp 10 is supported by the attachment of caps 17, which are attached to each end of the arc tube 11, to a flash lamp fulcrum 32 having a flash lamp supporting portion 33, by pressure members 35 constituted by plate springs; the first trigger member 20 is supported by the attachment of the two ends of the dielectric tube 21 to a trigger member fulcrum 36 having a trigger member supporting portion 37; the flash lamp fulcrum 32 and the trigger member fulcrum 36 are supported on a common base 31 such that the first trigger member 20 is disposed in a position which is parallel to (in FIG. 1, a position which is directly below) the flash lamp 10; and in this manner the flash lamp device is comprised in a flash emitting device.

Note that the flash lamp fulcrum 32 and the trigger member fulcrum 36 may be disposed separately on separate bases, for example, instead of on the common base 31.

In the flash lamp 10, an anode 14 constituted by tungsten, for example, and a cathode 15 constituted by barium aluminate-containing molybdenum, for example, which are formed on the respective front ends of electrodes 12, 13 constituted by tungsten, for example, which extend in protrusion from the two ends of the arc tube 11 in the inward tubular axis direction, face each other inside the light emitting space of the arc tube 11.

A noble gas such as xenon, for example, or mercury is sealed into the interior of the arc tube 11 in an appropriate amount.

As is illustrated in FIG. 3, the first trigger member 20 is constituted as follows: a trigger voltage applying lead pole 26 is electrically connected to the outer edge (the left-hand edge in FIG. 3) of one end 21A of the dielectric tube 21 which has an inner diameter of 1.8 mm, for example; the proximal conductor 27 having a linear form with an outer diameter of 1.0 mm, for example, is electrically connected to the inner edge (the right-hand end in FIG. 3) thereof; a hermetically sealed portion constituted by the embedding of a metal foil 25 made of tungsten, for example, is formed therein; and the proximal conductor 27 which extends in protrusion from this one end 21A in an inward tubular axis direction is slidably supported with the front end 27A thereof as a free end by a first protruding portion 22A formed from the inward protrusion of the inner peripheral surface of the dielectric tube 21 on the base end 27B side of the proximal conductor 27 and a second protruding portion 22B formed from the inward protrusion of the inner peripheral surface of the dielectric tube 21 on the front end 27A side of the proximal conductor 27.

The proximal conductor 27 is supported in the first trigger member 20 so as to only contact the inner peripheral surface of the dielectric tube 21 at the first protruding portion 22A and second protruding portion 22B.

The interior of the dielectric tube 21 is preferably one of either a vacuum atmosphere or an inert gas atmosphere.

If the interior of the dielectric tube 21 is set as a vacuum atmosphere, oxidation of the metallic proximal conductor 27 can be suppressed.

If interior of the dielectric tube 21 is set as an inert gas atmosphere, oxidation of the metallic proximal conductor 27 can be suppressed, and if gas is sealed therein so as to obtain a gas pressure based on Paschen's law, dielectric breakdown is produced more easily inside the dielectric tube 21 and electric discharge due to the application of trigger energy from the proximal conductor 27 occurs more easily.

Metals such as tungsten, nickel, aluminum, platinum, inconel (nickel-chromium-iron alloy), or molybdenum, for example, may be used as the constitutional material of the proximal conductor 27.

Further, there are no particular limitations on the outer diameter of the proximal conductor 27, but by having an entire length which is equal to or greater than the distance between the anode 14 and cathode 15 in the flash lamp 10, and by being disposed such that the front end 27A thereof is positioned further outward (further toward the right in FIG. 1) than the end (inner end) of the anode 14 and the base end 27B thereof is positioned further outward (further to the left in FIG. 1) than the end (inner end) of the cathode 15, the proximal conductor 27 extends from the anode 14 to the cathode 15 on the exterior of the arc tube 11.

A material with a greater permittivity than air is used as the constitutional material of the dielectric tube 21. More specifically, silica glass, ceramics, and so on may be used.

The thickness $t_1$ of the tube wall of the dielectric tube 21 is most preferably equal to the gap between the arc tube 11 and the proximal conductor 27.

By increasing the thickness $t_1$ of the tube wall of the dielectric tube 21, the amount of energy necessary for illuminating the flash lamp 10 (trigger energy) is reduced, as a result of which a high level of operational reliability can be obtained.

According to the flash lamp device of the above constitution, the proximal conductor 27 which constitutes the first trigger member 20 is used to apply trigger energy, whereby light is emitted from the flash lamp 10. Since the arc tube 11 of the flash lamp 10 and the proximal conductor 27 are provided at a remove from each other, the proximal conductor 27 is covered by the dielectric tube 21 which is a sealed tubular body, and the dielectric tube 21 which is a dielectric member with a greater permittivity than air is installed between the arc tube 11 and the proximal conductor 27, the following operational effects (1) through (4) are obtained, with the result that sufficient trigger energy with no light emission errors and a long working life are attained.

(1) Since the proximal conductor 27 does not contact the outer peripheral surface of the arc tube 11, damage to the arc tube 11 caused by scratches formed as a result of friction is prevented even when the proximal conductor 27 thermally expands upon reception of light emitted from the flash lamp 10.

(2) Since the high voltage supply proximal conductor material constituting the proximal conductor 27 is not attached to the arc tube 11, cracks in the arc tube 11 caused by the high voltage supply proximal conductor material becoming attached to the outer peripheral surface of the arc tube 11 can be prevented even when the high voltage supply proximal conductor material sputters and scatters.

The high voltage supply proximal conductor material can also be prevented from becoming attached to constitutional elements other than the dielectric tube 21 such as the base 31, the flash lamp fulcrum 32, the trigger member fulcrum 36, and the pressure members 35, for example.

Moreover, in the flash emitting device comprising this flash lamp device, the following, for example, can be prevented:

(a) If a reflecting mirror is provided, the high voltage supply proximal conductor material can be prevented from becoming attached to the surface of this reflecting mirror and thereby causing a deterioration in reflectance; (b) the cleanliness of a clean room can be prevented from deteriorating; (c) if a shield glass plate is provided between the object to be treated and the flash lamp, the high voltage supply proximal conductor material can be prevented from becoming attached to this shield glass and thereby causing a deterioration in illuminance; and (d) depending on the circumstances, the high voltage supply proximal conductor material can be prevented from mixing with the object to be treated.

(3) The proximal conductor 27 is in a state of separation from atmospheric oxygen, and therefore oxidation of the metallic proximal conductor 27 can be prevented, and as a result deterioration of the proximal conductor 27 can be suppressed.

(4) Since the dielectric tube 21 which is a dielectric member exists between the proximal conductor 27 and the arc tube 11 and the electric field concentration is relaxed, an electric arc is not drawn into the proximal conductor 27, as occurs in a case where a high voltage supply proximal conductor and an arc tube are adhered together, and thus deterioration in the light amount maintenance ratio due to changes in the color of the inner peripheral surface of the arc tube 11 which is positioned directly beneath the proximal conductor 27 can be prevented.

Further, since the flash lamp 10 and the first trigger member 20 are provided separately, either one of these constitutional members can be easily replaced.

Also, when the arc tube 11 and the proximal conductor 27 are separated and a layer of air exists between the arc tube 11 and the proximal conductor 27, it is usually difficult to produce a dielectric breakdown, but in the flash lamp device of the present invention, a dielectric member (the tube wall of the dielectric tube 21) with a greater permittivity than air is interposed between the arc tube 11 and the proximal conductor 27, and therefore, when an identical voltage is applied between the electrodes, a dielectric breakdown is more easily produced in comparison with a case in which only a layer of air exists between the arc tube and high voltage supply proximal conductor, and as a result a high level of operational reliability can be achieved.

By making the thickness $t_1$ of the tube wall of the dielectric tube 21 as great as the gap between the arc tube 11 and the proximal conductor 27, for example, an even higher level of operational reliability can be achieved.

Figure 4:
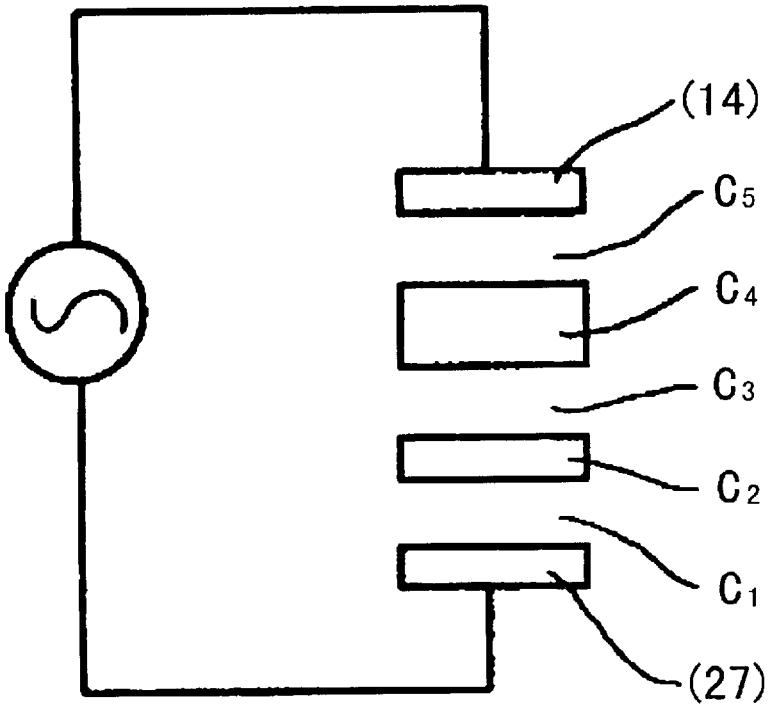
FIG. 4 is an equivalent circuit diagram showing a series capacitor.

The reason that a high level of operational reliability can be achieved by increasing the thickness $t_1$ of the tube wall of the dielectric tube 21 is that in this flash lamp device, as is illustrated in FIG. 4, if each of the constitutional elements of the flash lamp device and the air layers which are disposed between the electrode (anode 14) comprised in the flash lamp 10 and the proximal conductor 27 constituting the first trigger member 20 are considered as dielectrics, then these dielectrics are connected in series to thereby form a capacitor (also referred to as "series capacitor" herein below) with a composite capacitance expressed by the following expression (1).

In other words, by increasing the thickness $t_1$ of the tube wall of the dielectric tube 21, the composite capacitance of the series capacitor can be increased, and when illumination is performed with an identical inter-electrode voltage, as is shown in the following expression (2) in relation to the trigger energy, a greater trigger energy can be obtained as the capacitance of the capacitor increases, and as a result a high level of operational reliability can be achieved.

$$C_0=1/(1/C_1+1/C_2+1/C_3+1/C_4+1/C_5) \quad \text{Expression (1)}$$

[In the expression, $C_0$ indicates the composite capacitance of the series capacitor, $C_1$ indicates the capacitance of the capacitor constituted by the dielectric of the gas in the interior of the dielectric tube constituting the trigger member, $C_2$ indicates the capacitance of the capacitor constituted by the dielectric of the dielectric tube, $C_3$ indicates the capacitance of the capacitor constituted by the dielectric of the air between the trigger member and the flash lamp, $C_4$ indicates the capacitance of the capacitor constituted by the dielectric of the arc tube which constitutes the flash lamp, and $C_5$ indicates the capacitance of the capacitor constituted by the dielectric of the gas in the interior of the arc tube.]

$$E=\tfrac{1}{2}\times CV^2 \qquad \text{Expression (2)}$$

[In the expression, E is the trigger energy, C is the capacitor capacitance, and V is the inter-electrode voltage.]

Figure 5:
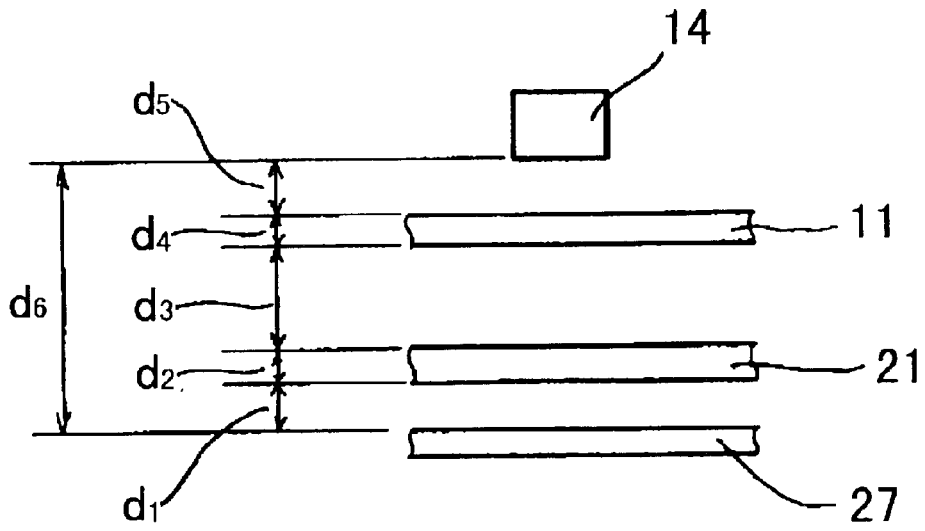
FIG. 5 is an illustrative view showing in outline the relationships between each of the constitutional elements of the flash lamp device in relation to the series condenser.

Specifically, in a flash lamp device in which the distance of separation $d_o$ between the electrode (anode 14) comprised in the flash lamp 10 and the proximal conductor 27 which constitutes the trigger member 20 is set as 7 mm using expression (1) and the following expression (3) in relation to the capacitance of the capacitor, as is illustrated in FIG. 5, in which silica glass is used as the constitutional material of the arc tube 11 and dielectric tube 21, in which xenon gas is sealed in the interior of the arc tube 11, and in which the interior of the dielectric tube 21 is set as a vacuum atmosphere, the relation between the composite capacitance of the series capacitor $C_0$ and the thickness $t_1$ of the tube wall of the dielectric tube 21 (in the expressions in the following description, this thickness is represented by "$d_2$") is as shown in the following expression (c) which is determined in the following manner.

$$C=\in\times S/d \qquad \text{Expression (3)}$$

[In the expression, $\in$ is the permittivity, S is the effective area of the electrode, and d is the thickness of the dielectric layer.]

First, $C_1$ to $C_5$ in the aforementioned expression (1) are replaced by expression (3) to obtain the following expression (a). By inserting each of the values in the following Table 1 into the obtained expression (a), the following expression (b) is obtained.

$$C=S/(d_1/\in_1+d_2/\in_2+d_3/\in_3+d_4/\in_4+d_5/\in_5 \qquad \text{(a) Expression (4)}$$

[In the expression, $\in_1$ indicates the permittivity of the gas in the interior of the dielectric tube which constitutes the trigger member, $\in_2$ indicates the permittivity of the dielectric tube, $\in_3$ indicates the permittivity of the air between the trigger member and the flash lamp, $\in_4$ indicates the permittivity of the arc tube which constitutes the flash lamp, and $\in_5$ indicates the permittivity of the gas in the interior of the arc tube. Further, $d_1$ indicates the thickness of the dielectric layer in relation to the gas in the interior of the dielectric tube, $d_2$ indicates the thickness of the dielectric layer in relation to the dielectric tube, $d_3$ indicates the thickness of the dielectric layer in relation to the air between the trigger member and the flash lamp, $d_4$ indicates the thickness of the dielectric layer in relation to the arc tube, and $d_5$ indicates the thickness of the dielectric layer in relation to the gas in the interior of the arc tube.]

TABLE 1

| | Permittivity | Thickness of Dielectric Layer |
|---|---|---|
| Capacitor in Relation to Gas Inside Dielectric Tube | 1 ($\epsilon_1$) | 0.4 ($d_1$) |
| Capacitor in Relation to Dielectric Tube | 3.8 ($\epsilon_2$) | — |
| Capacitor in Relation to Air between Trigger Member and Flash Lamp | 1 ($\epsilon_3$) | — |
| Capacitor in Relation to Arc Tube | 3.8 ($\epsilon_4$) | 1 ($d_4$) |
| Capacitor in Relation to Gas Inside Arc Tube | 1 ($\epsilon_5$) | 1.25 ($d_5$) |

$$C=S\times10^3/(0.4+d_2/3.8+d_3+1/3.8+1.25)=S\times10^3/(1.65+(1+d_2)/3.8+d_3) \qquad \text{(b) Expression (5)}$$

By replacing $d_3$ in the obtained expression (b) with the relation between $d_3$ and $d_2$ "$d_3=4.35-d_2$" which is obtained due to the fact that the separation distance $d_0$ between the electrode (anode 14) and the proximal conductor 27 is 7 mm and that $d_1$, $d_4$, and $d_5$ are clarified in Table 1, the following expression (c) is obtained.

$$C=S\times10^3/(1.65+(1+d_2)/3.8+4.3-d_2)=S\times10^3/(6+(1+d_2-3.8d_2)/3.8)=3.8S\times10^3/(23.8-2.8d_2) \qquad \text{(c)}$$

It can be confirmed according to this expression (c) that by increasing the thickness $t_1$ ($d_2$) of the tube wall of the dielectric tube 21, the composite capacitance $C_o$ of the series capacitor increases.

In the first trigger member 20, the proximal conductor 27 having its front end 27A as a free end is supported by the first protruding portion 22A and second protruding portion 22B, and the proximal conductor 27 does not contact the inner peripheral surface of the dielelctric tube 21 except at these protruding portions 22A, 22B, and therefore, even when the proximal conductor 27 thermally expands upon reception of light irradiated from the flash lamp 10, there is no occurrence of adverse effects such as damage to the arc tube 11 caused by scratches formed as a result of friction between the inner peripheral surface of the dielectric tube 21 and the proximal conductor 27, for example.

(Second Embodiment)

Figure 6:
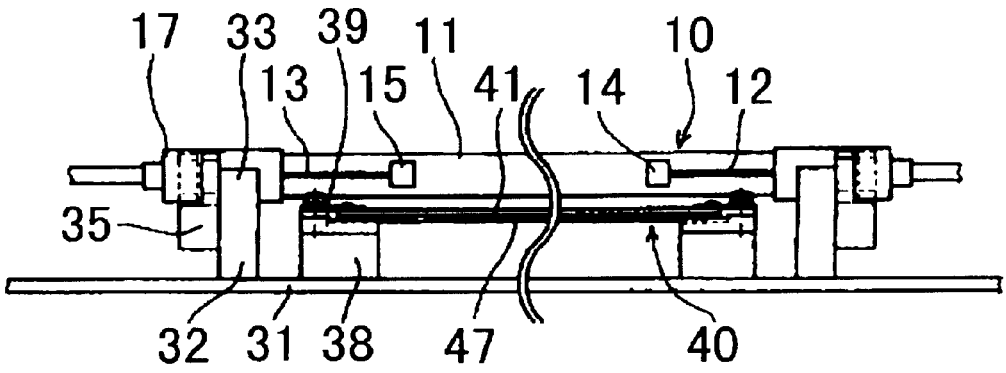
FIG. 6 is an illustrative view showing another example of the constitution of the flash lamp device of the present invention comprised in a flash emitting device.
Figure 7:
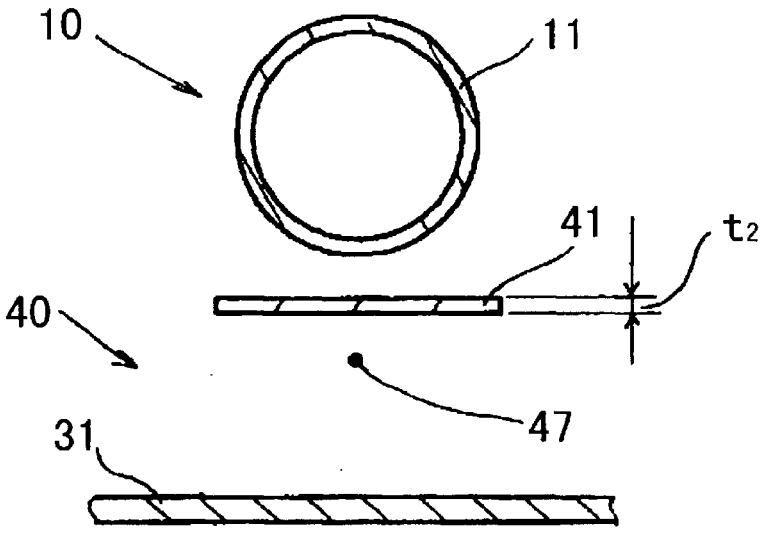
FIG. 7 is an illustrative sectional view showing the positional relationship between a flash lamp and a trigger member in the flash lamp device of FIG. 6.

FIG. 6 is an illustrative view showing another example of the constitution of the flash lamp device of the present invention comprised in a flash emitting device and FIG. 7 is an illustrative sectional view showing the positional relationship between a flash lamp and a trigger member in the flash lamp device of FIG. 6.

This flash lamp device has an identical constitution to that of the first embodiment apart from the fact that the first trigger member 20 constituted by the dielectric tube 21 which comprises a proximal conductor 27 in the interior space thereof is replaced by a trigger member (also referred to as "second trigger member" herein below) 40 which is constituted by a plate-form dielectric member (also referred to as "dielectric plate" herein below) 41, one surface of which is installed parallel to the arc tube 11 in the flash lamp 10, and a high voltage supply proximal conductor (also referred to simply as "proximal conductor" herein below) 47 in linear form which is installed so as to extend in the tubular axis direction of the arc tube 11 along the dielectric plate 41 and which serves as a masking shield for the dielectric plate 41.

In this example, the flash lamp 10 is supported by the attachment of caps 17, which are attached to each end of the arc tube 11, to a flash lamp fulcrum 32 having a flash lamp supporting portion 33, by pressure members 35 constituted by plate springs; the dielectric plate 41 and the proximal conductor 47 in second trigger member 40 are supported by the attachment of the two ends of the dielectric tube 41 to a trigger member fulcrum 38 having a trigger member supporting portion 39; the flash lamp fulcrum 32 and the trigger member fulcrum 38 are supported on a common base 31 such that the second trigger member 40 is disposed in a position in which the second trigger member 40 is parallel to (in FIG. 6, a position which is directly beneath) the flash lamp 10; and in this manner the flash lamp device is comprised in a flash emitting device.

Note that the flash lamp fulcrum 32 and the trigger member fulcrum 38 may be disposed separately on separate bases, for example, instead of on the common base 31.

It is preferable for the dielectric plate 41 and the proximal conductor 47 in the second trigger member 40 to be disposed at a remove from each other.

It is most preferable for the vertical width of the dielectric plate 41 to be equal to or greater than the length of the proximal conductor 47, for the horizontal width thereof to be equal to or greater than the outer diameter of the proximal conductor 47, and for the thickness $t_2$ thereof to be equal to the gap between the arc tube 11 and the high voltage supply proximal conductor 21.

As the material of the dielectric plate 41, a similar material to that of the dielectric tube 21 in the first embodiment may be used. As for the constitutional elements which constitute the second trigger member 40 other than the dielectric plate 41, those cited in the first embodiment may be favorably employed.

According to a flash lamp device of such a constitution, light from the flash lamp 10 is emitted by the application of trigger energy using the proximal conductor 47 which constitutes the second trigger member 40. By providing the arc tube 11 of this flash lamp 10 and the proximal conductor 47 at a remove from one another, and by providing the proximal conductor 47 via the dielectric plate 41 which serves as a masking shield, a dielectric member with a greater permittivity than air is installed between the arc tube 11 and proximal conductor 47, and thus the following operational effects (1) through (3) are obtained with the result that sufficient trigger energy with no light emission errors and a long working life are attained.

(1) Since the proximal conductor 47 does not contact the outer peripheral surface of the arc tube 11, damage to the arc tube 11 caused by scratches formed as a result of friction is prevented even when the proximal conductor 47 thermally expands upon reception of light emitted from the flash lamp 10.

(2) Since the high voltage supply proximal conductor material constituting the proximal conductor 47 is not attached to the arc tube 11, cracks in the arc tube 11 caused by the high voltage supply proximal conductor material becoming attached to the outer peripheral surface of the arc tube 11 can be prevented even when the high voltage supply proximal conductor material sputters and scatters.

(3) Since the dielectric tube 41 which is a dielectric member exists between the proximal conductor 47 and the arc tube 11 and the electric field concentration is relaxed, an electric arc is not drawn into the proximal conductor 47, as occurs in a case where a high voltage supply proximal conductor and an arc tube are adhered together, and thus deterioration in the light amount maintenance ratio due to changes in the color of the inner peripheral surface of the arc tube 11 which is positioned directly beneath the proximal conductor 47 can be prevented.

Further, since a dielectric member (the dielectric plate 41) with a greater permittivity than air is interposed between the arc tube 11 and proximal conductor 47, dielectric breakdown is more easily generated than in a case where only a layer of air exists between the arc tube and high voltage supply proximal conductor when an identical inter-electrode voltage is applied, and as a result a high level of operational reliability can be achieved.

Also, by setting the thickness $t_2$ of the dielectric plate 41 as large as the gap between the arc tube 11 and high voltage supply proximal conductor 41, for example, an even higher level of operational reliability can be achieved.

Moreover, since the flash lamp and the proximal conductor 47 and dielectric plate 41 which constitute the second trigger member 40 are provided separately, either one of these constitutional members can be easily replaced.

Various modifications may be added to the flash lamp device of the present invention.

For example, the dielectric member which constitutes the trigger member may be provided in contact with the outer peripheral surface of the arc tube in the flash lamp.

In this case, when illumination is performed using an identical inter-electrode voltage, greater trigger energy can be obtained as the gap between the dielectric member and arc tube narrows, and therefore a high level of operational reliability can be achieved.

Figure 8:
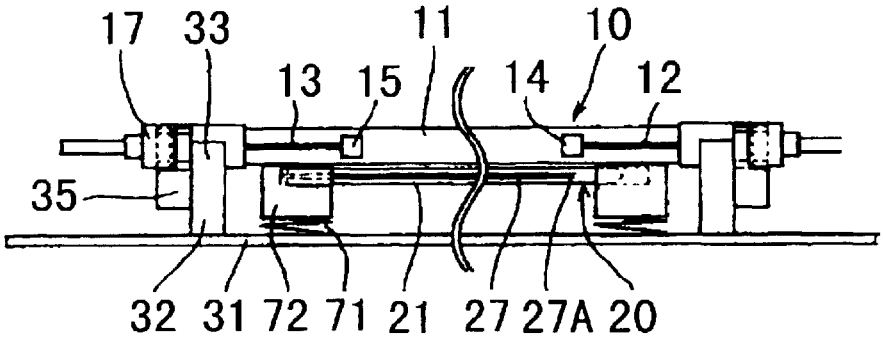
FIG. 8 is an illustrative view showing means for causing a dielectric tube in the trigger member to contact the outer peripheral surface of an arc tube in the flash lamp.
Figure 9:
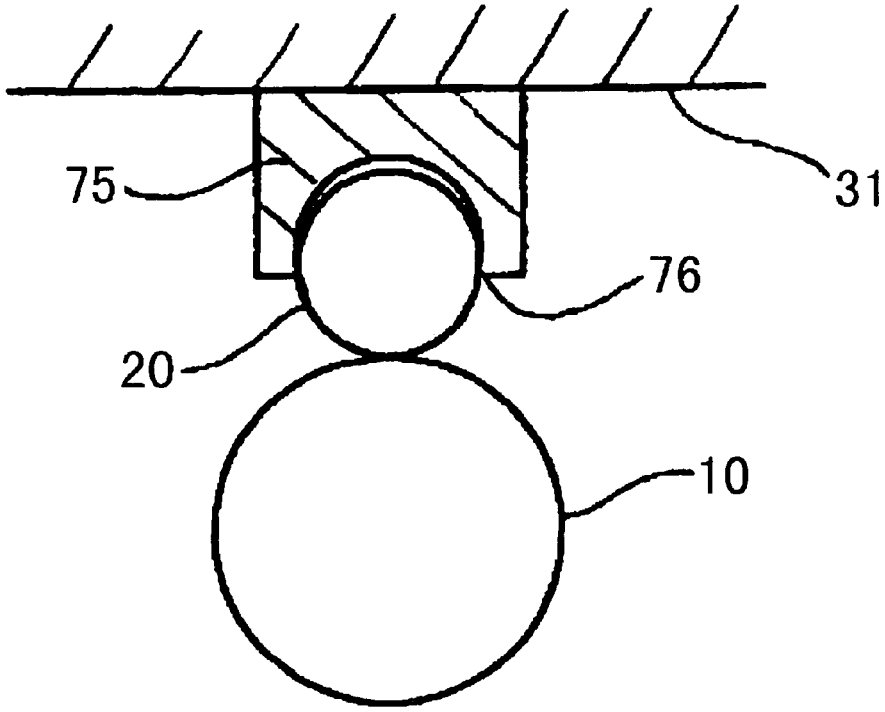
FIG. 9 is an illustrative view showing other means for causing the dielectric tube in the trigger member to contact the outer peripheral surface of the arc tube in the flash lamp.

As means for bringing the dielectric member constituting the trigger member into contact with the outer peripheral surface of the arc tube in the flash lamp, the following means, among others, may be cited as examples: (1) supporting the trigger member fulcrum 72 on the base 31 via an elastic body material such as a spring 71, for example, and using the elasticity of this elastic body material to impact the trigger member against the outer peripheral surface of the arc tube, as is illustrated in FIG. 8; or (2) providing a constitution for a flash lamp device having a flash lamp 10 which irradiates light downward (downward in FIG. 9) in which the trigger member supporting portion 76 on the trigger member fulcrum 75 is supported such that the trigger member 20 is movable in the direction of height of the trigger member fulcrum 75, and using the weight of the trigger member 20 to cause contact, as is illustrated in FIG. 9.

The first trigger member in the first embodiment may have the following constitutions (a) through (c).

Figure 10:
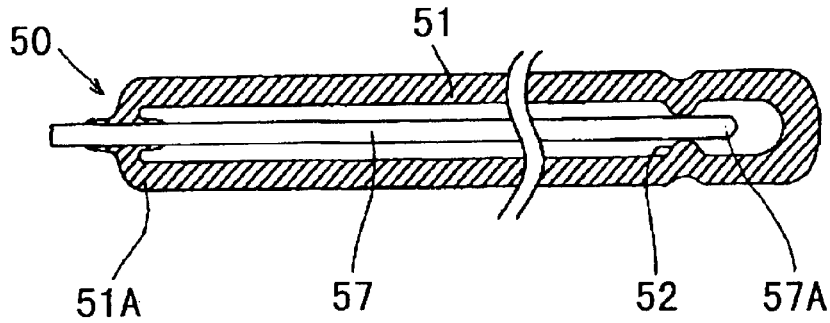
FIG. 10 is an illustrative sectional view showing the constitution of another example of a trigger member.

(a) A constitution as is illustrated in FIG. 10, in which a hermetically sealed portion with a so-called stepped joint sealed constitution is formed on each end of a dielectric tube 51 which is a sealed tubular body, and a linear form high voltage supply proximal conductor (also referred to simply as "proximal conductor" herein below) 57 which extends in protrusion from one end 51A of the dielectric tube 51 in the inward tubular axis direction is slidably supported with its front end 57A as a free end by a protruding portion 52 formed from an inward protrusion of the inner peripheral surface of the dielectric tube 51 on the front end 57A side of the proximal conductor 57.

Figure 11:
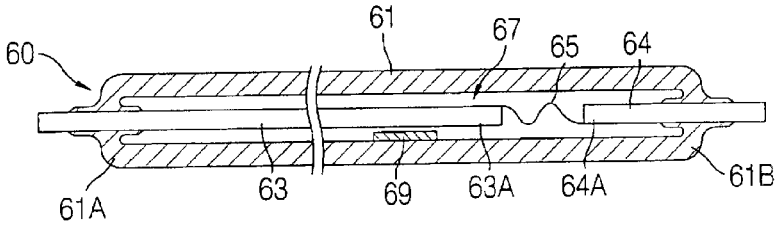
FIG. 11 is an illustrative sectional view showing the constitution of a further example of a trigger member.

(b) A constitution as is illustrated in FIG. 11, in which a hermetically sealed portion with a so-called stepped joint sealed constitution is formed on each end of a dielectric tube 61 which is a sealed tubular body, and which is provided with a high voltage supply proximal conductor (also referred to simply as "proximal conductor" herein below) 67 comprising a first linear portion 63 formed from tungsten wire, for example, which protrudes inward from one end 61A of the dielectric tube 61 in the tubular axis direction, a second linear portion 64 formed from tungsten wire, for example, which protrudes inward from the other end 61B of the dielectric tube 61 in the tubular axis direction, and a compensating member 65 formed from molybdenum foil, for example, which is provided in curved form with one end thereof connected to the front end 63A of the first linear portion 63 by means of spot welding, for example, the other end thereof connected to the front end 64A of the second linear portion 64 by spot welding, for example, and having a greater length than the distance of separation between these front ends 63A and 64A.

In this case, the two ends of the proximal conductor 67 are sealed in the dielectric tube 61, but due to the action of the compensating member 65, even if the first linear portion 63 and second linear portion 64 thermally expand upon reception of light irradiated from the flash lamp 10, for example, accompanying damage to the arc tube 11 such as cracking or the like does not occur.

If the atmosphere around the flash lamp device is a nitrogen atmosphere, for example, the trigger member may be constituted such that the high voltage supply proximal conductor is covered by a tubular form dielectric material in which both ends are not sealed. This tubular dielectric material may have an entire length which is at least equal to the distance between the anode and cathode, which is the electric arc length, as a result of which scattering of the high voltage supply proximal conductor material can be prevented.

It goes without saying that if the influence from peripheral flash lamps is large, this length may be selected appropriately.

Further, the trigger member including the dielectric tube may be constituted such that a solid getter 69, as shown in FIG. 11, is formed from barium, an alloy of zirconium and aluminum, or the like, and is inserted into the interior of the dielectric tube.

In this case, the solid getter absorbs oxygen in advance so that the high voltage supply proximal conductor comprised in the interior of the dielectric tube does not react with oxygen in the dielectric tube upon reception of light irradiated from the flash lamp 10. Thus oxidation of the high voltage supply proximal conductor can be securely prevented.

Figure 12:
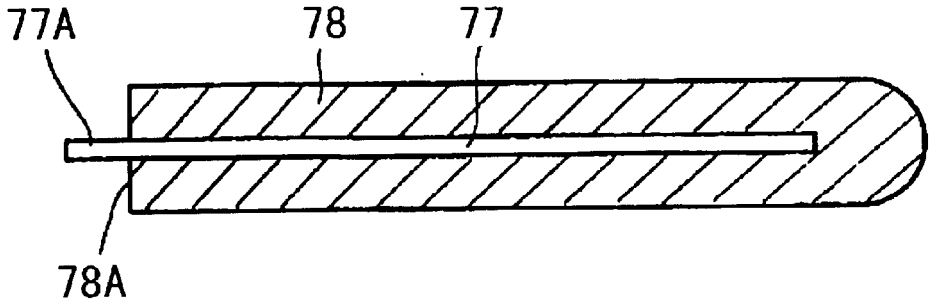
FIG. 12 is an illustrative sectional view showing the constitution of a further example of a trigger member.

As is illustrated in FIG. 12, the trigger member may have a constitution in which molybdenum foil 77 is used as the high voltage supply proximal conductor and this molybdenum foil 77 is sealed into a dielectric member 78 constituted by silica glass, for example.

In the example in the drawing, one end portion (the left-hand end in FIG. 12) 77A of the molybdenum foil 77 protrudes from one end (the left-hand end in FIG. 12) of the dielectric member 78 to serve as a trigger voltage applying part.

In this case thermal expansion of the molybdenum foil 77 itself is suppressed to within the range of metal plastic deformation, and therefore the dielectric member 78 does not crack even when the molybdenum foil 77 is at a high temperature. As a result, the trigger member itself does not break.

A flash emitting device comprising a flash lamp device as described above may be used as the heat source of a heat treatment device for heat treating a semiconductor substrate, liquid crystal substrate, and so on, for example. According to such a heat treatment device, the high voltage supply proximal conductor material in the high voltage supply proximal conductor, which sputters upon reception of light irradiated from the flash lamp, can be prevented from scattering outward from the dielectric member, whereby the high voltage supply proximal conductor material can be prevented from becoming attached to the object to be treated and deterioration of the working environment can be suppressed.

Figure 13:
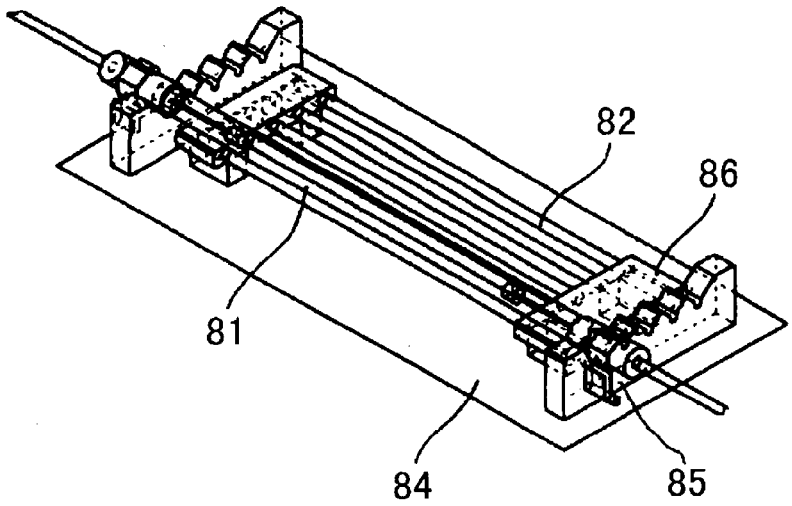
FIG. 13 is an illustrative perspective view showing an example of the constitution of a flash emitting device of the present invention.

The flash emitting device may also be constituted by a plurality of flash lamp devices, as is shown in FIG. 13.

In the example in FIG. 13, a plurality of (five in FIG. 13) long cylindrical flash lamps 81 arrayed in parallel are supported on a common flash lamp fulcrum 85 and a number of trigger members 82 which is equal to the number of flash lamps 81 is supported on a common trigger member fulcrum 86, each disposed in a position which is parallel to (in FIG. 13, a position which is directly beneath) the corresponding flash lamp 81. The flash lamp fulcrum 85 and trigger member fulcrum 86 are supported separately on a common base 84.

Note that in FIG. 13, only one of the plurality of flash lamps 81 is shown.

Experiments conducted to confirm the operational effects of the present invention will now be described.

<Experiment 1>

Flash lamp devices (a) through (c) were manufactured in accordance with the constitution illustrated in FIG. 1, each comprising a flash lamp and a trigger member as described below and a dielectric tube with an outer diameter and inner diameter as shown in the following Table 2. A flash lamp device (d) was also manufactured with an identical constitution to the flash lamp device (a) apart from the fact that instead of the trigger member, the high voltage supply proximal conductor used in the trigger member was installed on the exterior of the arc tube constituting the flash lamp at a remove from this arc tube.

(Flash Lamp)

Arc tube: silica glass (overall length 360 mm, inner diameter 8.5 mm, outer diameter 10.5 mm)

Cathode: barium aluminate-containing molybdenum

Anode: tungsten

Distance between electrodes: 280 mm

Filler gas: xenon gas (charged pressure 450 Torr)

(Trigger Member)

Dielectric tube: silica glass (overall length 320 mm)

High voltage supply proximal conductor: tungsten wire (outer diameter 1 mm, overall length 290 mm)

Metal foil in hermetically sealed portion: molybdenum foil

Interior of dielectric tube: vacuum atmosphere

TABLE 2

| | Outer Diameter | Inner Diameter | Thickness $t_1$ of Tube Wall |
|---|---|---|---|
| Lamp (a) | 4.5 | 1.8 | 1.35 |
| Lamp (b) | 3.4 | 1.8 | 0.8 |
| Lamp (c) | 2.7 | 1.8 | 0.45 |

In the obtained flash lamp devices (a) through (d), the minimum trigger energy for generating a dielectric breakdown was measured while altering the distance of separation between the electrodes (anode and cathode) and the high voltage supply proximal conductor. The results are illustrated in FIG. 14.

Figure 14:
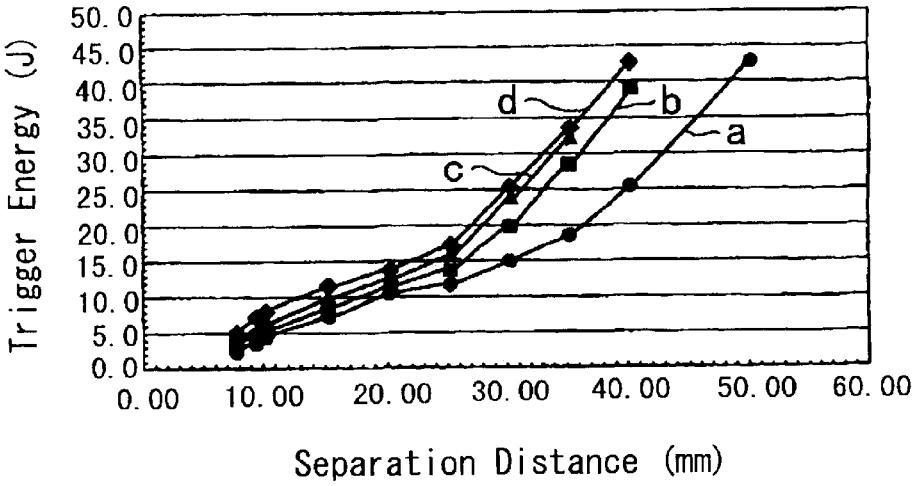
FIG. 14 is a view showing the relationship between the trigger energy necessary to illuminate the flash lamp device and the separation distance between electrodes and a high voltage supply proximal conductor.

In FIG. 14, the results of flash lamp device (a), flash lamp device (b), flash lamp device (c), and flash lamp device (d) are illustrated by the curved line (a), the curved line (b), the curved line (c), and the curved line (d) respectively.

From these results, the following was confirmed: by interposing the dielectric tube between the electrodes and the high voltage supply proximal conductor, the amount of trigger energy necessary for illuminating the flash lamp device is reduced; the amount of trigger energy necessary for illuminating the flash lamp device decreases as the thickness of the tube wall of the dielectric tube which constitutes the trigger member becomes larger; and when the distance of separation between the electrodes and the high voltage supply proximal conductor is constant, the amount of trigger energy necessary for illuminating the flash lamp device decreases as the thickness of the tube wall of the dielectric tube becomes larger.

It was thus learned that in a flash lamp device comprising a dielectric tube with a thick tube wall, the flash lamp device can be illuminated using a small amount of trigger energy, as a result of which a higher level of operational reliability can be obtained.

EXAMPLES

Specific examples of implementation of the present invention will now be described. However, the present invention is not limited to or by these examples.

Example 1

A flash lamp device was manufactured in accordance with the constitution shown in FIG. 1, comprising the flash lamp and trigger member as described below and with a distance of separation between the electrodes (anode and cathode) and the high voltage proximal conductor of 7.75 mm.

(Flash Lamp)

Arc tube: silica glass (overall length 360 mm, inner diameter 8.5 mm, outer diameter 10.5 mm)

Cathode: barium aluminate-containing molybdenum

Anode: tungsten

Distance between electrodes: 280 mm

Filler gas: xenon gas (charging pressure 450 Torr)

(Trigger Member)

Dielectric tube: silica glass (overall length 320 mm, inner diameter 1.8 mm, outer diameter 4.5 mm)

High voltage supply proximal conductor: tungsten wire (outer diameter 1 mm, overall length 290 mm)

Metal foil in hermetically sealed portion: molybdenum foil

Interior of dielectric tube: vacuum atmosphere

Having illuminated the obtained flash lamp device 50,000 times under the following conditions, the outer peripheral surface of the arc tube in the flash lamp device was visually observed and confirmation was made that no attachment of high voltage supply proximal conductor material and no scratches had occurred.

Input energy of flash lamp: 3750 J (capacitor capacity: 1200 $\mu$F, charge voltage 2500V)

Trigger energy: 27 mJ (capacitor capacity: 0.44 $\mu$F, charge voltage 330V)

Trigger output release voltage 15 kV

According to the flash lamp device of the present invention, an arc tube of a flash lamp and a high voltage supply proximal conductor are provided at a remove from each other and a dielectric member with a greater permittivity than air is installed between the arc tube and the high voltage supply proximal conductor, and thus damage caused by the sputtering phenomenon displayed by the high voltage supply proximal conductor material of the high voltage supply proximal conductor and the thermal expansion phenomenon displayed by the high voltage supply proximal conductor upon reception of light emitted from the flash lamp can be prevented, with the result that sufficient trigger energy without light emission errors and a long working life are obtained.

The flash emitting device according to the present invention comprises a plurality of the flash lamp devices described above, and thus sufficient trigger energy without light emission errors and a long working life are obtained.

What is claimed is:

1. A flash lamp device comprising:

a flash lamp having an arc tube in which a pair of electrodes are disposed in opposition; and a high voltage supply proximal conductor which extends parallel to the electrodes, wherein said high voltage supply proximal conductor is supported in a portion of an interior space of a sealed tubular body comprising a dielectric member with a greater permittivity than that of air, and wherein said flash lamp is attached to a base and the sealed tubular body is elastically attached to the base by an elastic body material, and the sealed tubular body is impacted with the elastic body material against an outer peripheral surface of the arc tube.

2. The flash lamp device according to claim 1, wherein the dielectric member comprises silica glass.

3. The flash lamp device according to claim 1, wherein at least one end of the high voltage supply proximal conductor is sealed within the sealed tubular body, and the interior of the sealed tubular body is set as a vacuum atmosphere.

4. The flash lamp device according to claim 1, wherein at least one end of the high voltage supply proximal conductor is sealed within the sealed tubular body, and the interior of the sealed tubular body is set as an inert gas atmosphere.

5. The flash lamp device according to claim 1, wherein the high voltage supply proximal conductor is slidably held by protruding portions formed by inward protrusions of an inner peripheral surface of the sealed tubular body.

6. The flash lamp device according to claim 1, wherein a solid getter is provided in the interior of the sealed tubular body.

7. A flash emitting device comprising a plurality of the flash lamp devices according to claim 1, each of said plurality of flash lamp devices either comprising the arc tube, the high voltage supply proximal conductor, and the dielectric member supported separately on a common base, or comprising the arc tube and a composite body consisting of the high voltage supply proximal conductor and the dielectric member supported separately on a common base.

* * * * *